US010265759B2

(12) United States Patent
Mezzaqui

(10) Patent No.: US 10,265,759 B2
(45) Date of Patent: Apr. 23, 2019

(54) RETENTION AND RELEASE MECHANISM FOR A POWER TOOL

(71) Applicant: AVDEL UK LIMITED, Hertfordshire (GB)

(72) Inventor: Oriano Mezzaqui, Bologna (IT)

(73) Assignee: AVDEL UK LIMITED (GB)

( * ) Notice: Subject to any disclaimer, the term of this patent is extended or adjusted under 35 U.S.C. 154(b) by 832 days.

(21) Appl. No.: 14/883,903

(22) Filed: Oct. 15, 2015

(65) Prior Publication Data

US 2016/0107225 A1 Apr. 21, 2016

(30) Foreign Application Priority Data

Oct. 20, 2014 (GB) ..... 1418586.2

(51) Int. Cl.
*B21J 15/32* (2006.01)
*B21J 15/10* (2006.01)
*B25B 27/00* (2006.01)

(52) U.S. Cl.
CPC ..... *B21J 15/32* (2013.01); *B21J 15/105* (2013.01); *B25B 27/0014* (2013.01)

(58) Field of Classification Search
CPC ..... B25B 27/00; B25B 27/0014; B21J 15/06; B21J 15/105
See application file for complete search history.

(56) References Cited

U.S. PATENT DOCUMENTS 3,181,338 A * 5/1965 Zetterlund ..... B25B 27/00 29/524.1
3,654,792 A * 4/1972 Mead ..... B21J 15/105 29/243.524
3,762,200 A * 10/1973 Still ..... B25B 27/0014 72/114
4,074,554 A * 2/1978 Summerlin ..... B21J 15/105 72/114
4,574,612 A * 3/1986 Tanikawa ..... B25B 27/0014 72/114
6,732,563 B1 * 5/2004 Chen ..... B21J 15/043 29/243.53
2004/0118176 A1 6/2004 Neri
2009/0084229 A1 2/2009 Villanueva
2015/0112372 A1 7/2015 Perez Grossmann

FOREIGN PATENT DOCUMENTS

EP 1392459 3/2004
WO 0141953 6/2001

* cited by examiner

*Primary Examiner* — Daniel J Wiley
(74) *Attorney, Agent, or Firm* — Kofi A. Schulterbrandt; Michael P. Leary

(57) ABSTRACT

A manually-actuated retention and release mechanism is disclosed for use with a blind threaded rivet setting tool. The mechanism has a cap with an internal screw thread which retains a drive screw immovably to a spindle such that axial or rotational movement of the spindle results in concomitant movement of the drive screw. The cap cooperates with a manually-actuable bar via series of serrations formed on the cap, each of which serrations is a latch point for the bar. Movement of the bar into or out of engagement with the serrations dictates whether or not the cap is locked in position.

11 Claims, 7 Drawing Sheets

RETENTION AND RELEASE MECHANISM FOR A POWER TOOL

CROSS-REFERENCE TO RELATED APPLICATIONS

This application claims priority from UK Patent Application No. GB1418586.2, filed Oct. 20, 2014, the disclosure of which is incorporated herein by reference in its entirety.

FIELD OF THE INVENTION

The present invention relates to a retention and release mechanism for a power tool and a power tool including such a retention and release mechanism and has particular, although not exclusive, relevance, to such mechanisms as are employed in hydro-pneumatic blind threaded insert placing tools used in industrial fastening environments.

Hydro-pneumatic tools for placing and setting blind threaded insert rivets are known. The tools employ a hydro-pneumatic (by which is meant a combination of compressed gaseous fluid, such as air and compressed liquid fluid, such as oil) system as different pressures are often required for different tasks the tool must achieve in order to set a blind threaded insert, or rivet. For example, where the rivet to be set in a workpiece (such as a sheet of metal) is one which has both to be i) held by the tool before insertion in to the workpiece and ii) upset or deformed to be permanently retained in the workpiece, then often the forces required to achieve each of i) and ii) can be different. The force differential necessitates the power tool employing different means for powering each of task i) and ii).

BACKGROUND OF THE INVENTION

An example of such a power tool from the prior art is shown in EP 0,999,906-A. The tool employed, a rivet gun, uses compressed air to spin its externally-threaded drive screw into a correspondingly internally-threaded blind rivet shank before inserting and then setting the rivet in a workpiece. The force required to achieve the initial part of this process, the so-called "spin-on" of the rivet onto the tool's drive screw is relatively weak, as no structural deformation of the rivet is yet required. All that is needed is for the rivet to be mounted on the drive screw of the rivet gun as quickly and efficiently as possible. This is necessary as, in a manufacturing environment, time required to have the gun ready to set the rivet in a workpiece needs to be minimised for production line efficiencies. Once the rivet has been spun-on to the drive screw, it is ready to be inserted into a hole formed in a workpiece and upset, or deformed. It is this deformation process which requires a relatively higher force than the initial spin-on force. For this deformation, an oil reservoir is employed within the tool to drive a hydraulic ram in order to axially deform the rivet such that it is then permanently mounted within the workpiece. Such axial rivet deformation is, per se, known and so will not be described further herein.

EP 0,999,906-A discloses a rivet gun, rather than a static piece of installation equipment (such as a floor-mounted machine), as it is both manually held and operated. Such manual operation tends to occur in industrial manufacturing environments where use of automated machines is sporadic or expensive or in the case where the operator's manual dexterity is required. However, manual use of the rivet gun brings its own problems. One such problem is the propensity for an operator to drop the rivet gun, possibly damaging the drive screw. Damage could include bending the drive screw out of true, or scraping its external thread. In either case, damage to the drive screw thread could prevent spin-on of the rivet onto the drive screw. Furthermore, if the thread of the drive screw became worn or damaged whilst the tool were setting the rivet in the workpiece, then the operator might not be able to remove the drive screw from the set rivet—this process is generally known as "spin-off" and involves the drive screw rotating in the opposite sense to that when spin-on occurs. The spin-off process simply removes the drive screw from within the rivet after the setting process is complete.

It will be appreciated that, for efficiency of manufacturing processes, the spin-off operation, after the rivet has been set in the workpiece, should be as rapid as possible so that the operator of the rivet gun to move onto the next rivet which needs to be spun-on to the drive screw and set in a workpiece. Rapid spin-off of the drive screw from the set rivet could be prevented if there were damage caused to the thread of the drive screw.

In order to cater for dealing with damaged drive screws or stripped drive screw threads, for example, the prior art rivet guns, such as that disclosed in EP 0,999,906-A offer the possibility to change the drive screw.

Another reason why there may be the need to change the drive screw could be when a different diameter threaded rivet needs to be installed in a workpiece and the different diameter of the internal rivet thread requires the diameter of the external thread of the rivet gun drive screw to be changed correspondingly. There are such rivet guns known in the art and an example of the retention mechanism for which is shown schematically in FIG. 1. In FIG. 1 a portion of the Avdel® 74201 rivet gun is illustrated. It can be seen that a threaded cap 2 is screwed into a spindle 4 together with a plastic or rubber O-ring 6 which provides an interference fit between the cap 2 and spindle 4 to provide prevailing torque which inhibits vibration loosening. In order to change the drive screw, it is typically necessary to use two spanners—one applied to the flat region 3 of cap 2 and one applied to flat region 5 of the spindle 4 in order to untighten and then re-tighten the two together. This not only takes time, but also requires the correct spanners to be available.

If, on re-tightening, the correct torque has not been applied, it is possible for the cap 2, over time, to unscrew from the spindle 4. This could mean loss of rotational drive and hence prevent spin-on, spin-off or both.

BRIEF SUMMARY OF THE INVENTION

It is thus an object of the present invention to at least alleviate the aforementioned problems by providing a manually-actuable retention and release mechanism which can be more rapidly employed than has hitherto been possible and which does not have the propensity to loosen over time. Accordingly, the present invention provides, in a first aspect, a retention and release mechanism for a power tool comprising:

a mounting member, which mounting member carries a first external screwthread formed thereon and which mounting member includes a first coupling means;

a drive screw, which drive screw carries a second external screwthread formed thereon and which drive screw includes a second coupling means, the second coupling means arranged for selective engagement with the first coupling means of the mounting member;

a releasable locking member arranged to be selectively coupled to both the mounting means and the drive screw for immovable retention of the drive screw to the mounting means, and;

a manually-actuable detent having locked and a released positions wherein, in the locked position, the detent restrains the releasable locking means to prevent uncoupling of the mounting means from the drive screw and in the released position, the detent allows uncoupling of the mounting means form the drive screw.

Thus, according to the first aspect of the present invention, provision of a detent ensures that, during use of the mechanism, there is no possibility of the first coupling means of the mounting member and the second coupling means of the drive screw becoming uncoupled. Furthermore, as the detent is manually-actuable, there is no need for the operator of the mechanism to employ tools such as spanners or the like to operate the mechanism. This means a more rapidly used mechanism is provided than in the prior art.

Preferably the detent is biased towards the locked position. This means that the default position for the detent is to lock the mounting member to the drive screw preventing unwanted uncoupling.

Additionally the detent may be biased via a compression spring.

In a preferred embodiment the releasable locking member carries a third internal screwthread to mate with the first external screwthread of the mounting means. This enables a convenient coupling of the releasable locking member to the mounting member.

Advantageously, the releasable locking means has a portion thereof formed with a wave structure, which wave structure cooperates with the detent to prevent relative movement between the releasable locking means and the detent when the detent is in the locked position. This facilitates retention of the releasable locking means by the detent in any chosen position determined by the user.

Additionally or alternatively the mounting member, the drive screw and the releasable locking member are all arranged co-axially and concentrically about a drive axis. Such an arrangement permits of a compact mechanism which itself facilities insertion of rivets into workpieces.

Advantageously the detent is moved axially between the locked and released position. Furthermore, the detent may be rotated about the drive axis in order to move from its locked position towards its released position, or vice versa.

According to a second aspect of the present invention there is provided a powertool including a mechanism as set out in the first aspect.

BRIEF DESCRIPTION OF THE DRAWINGS

The present invention will now be described, by way of example only and with reference to the accompanying drawings, of which.

DETAILED DESCRIPTION OF THE INVENTION

Figure 1:
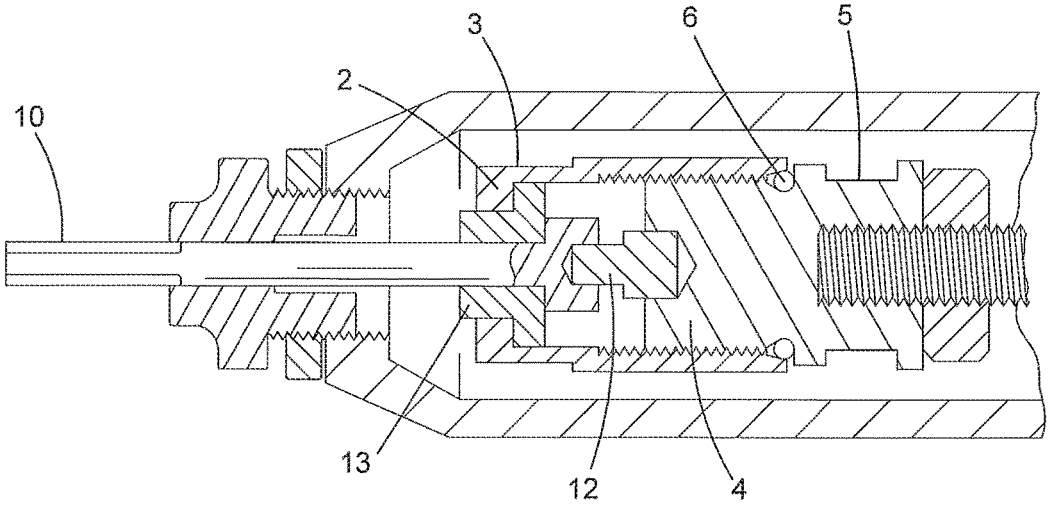
FIG.1 PRIOR ART
FIG. 1 shows a cross-sectional illustration of part of a prior art rivet gun employing a known retention mechanism.

Referring to FIG. 1, it can be seen that the cap 2, spindle 4 and locking O-ring 6 described above are all shown. The operator would need to use spanners to remove or replace the drive screw 10, as discussed above. A drive bit 12 sits between the spindle 4 and drive screw 10 and is used to impart rotary drive torque from the spindle 4 to the drive screw 10. If different diameter drive screws 10 are required for different diameter rivets, for example, use of an adaptor sleeve 13 is employed. However, it is when the operator unscrews the cap from the spindle 4 with spanners via flat regions 3 and 5 that problems may occur. If, for example, the cap 2 were not fully screwed back into its locking position (towards the right of the figure), it could, during further use of the tool, unscrew from the thread of the spindle 4. If this were to happen, rotational drive would be lost, as the drive bit 12 could disengage from either the drive screw 10 or the spindle 4 end.

Alternatively, if the O-ring 6 were not properly seated in its annular recess in the spindle 4, the cap 2 could unscrew over time. The same effect could occur with deterioration of the O-ring itself, usually being made from nitrile rubber or nylon.

Figure 2:
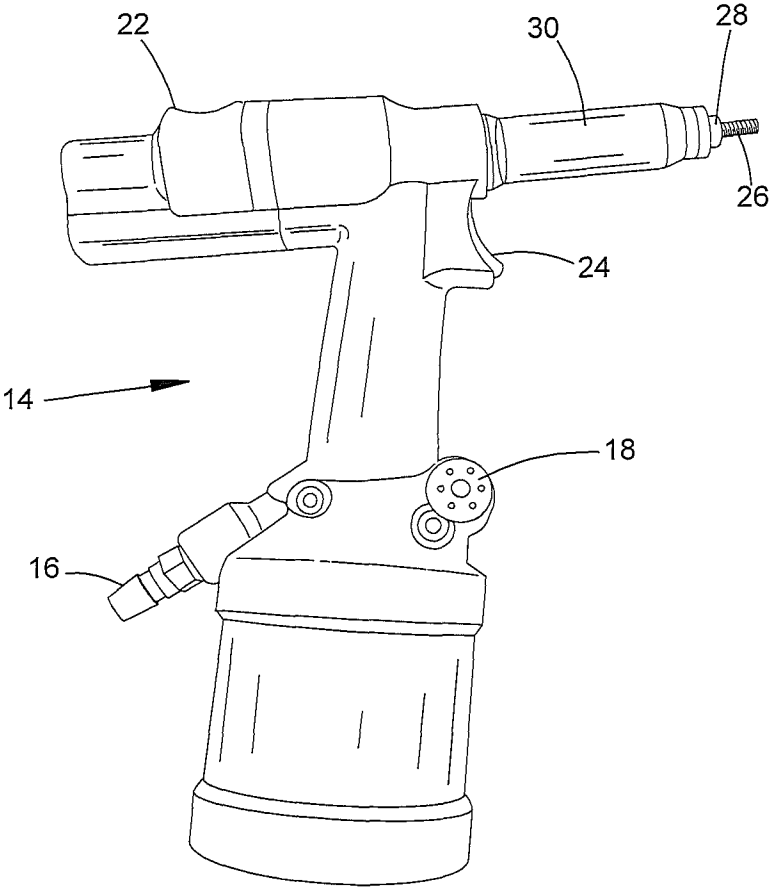
FIG. 2 shows a side view of a rivet setting power tool employing a novel retention and release mechanism in accordance with the present invention.
Figure 3:
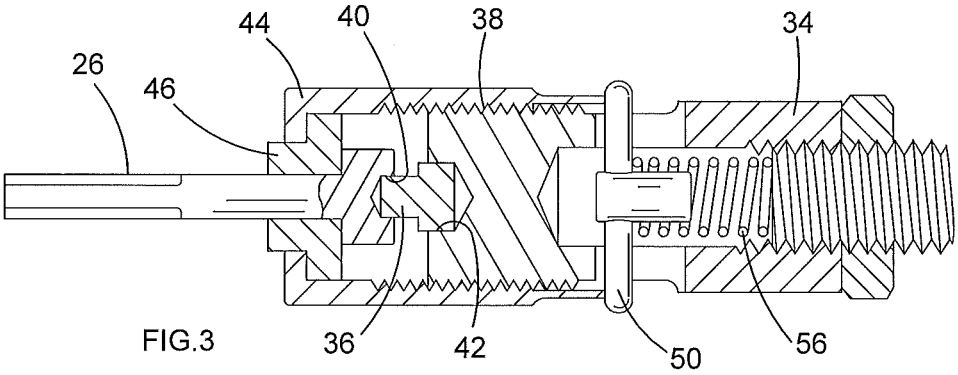
FIG. 3 shows a schematic cross-section of a novel retention and release mechanism in accordance with the present invention.
Figure 4:
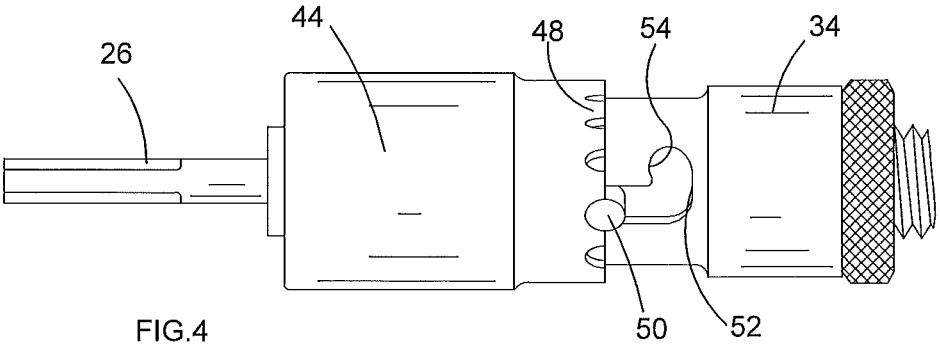
FIG. 4 shows a schematic side view of the retention and release mechanism of FIG. 3.
Figure 5:
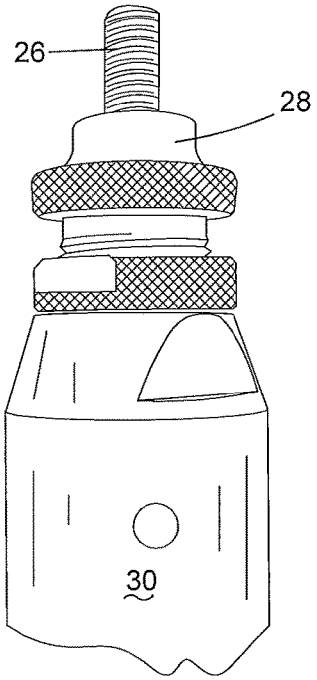
FIG. 5 shows a top view of a power tool rivet gun drive screw in accordance with the present invention.
Figure 6:
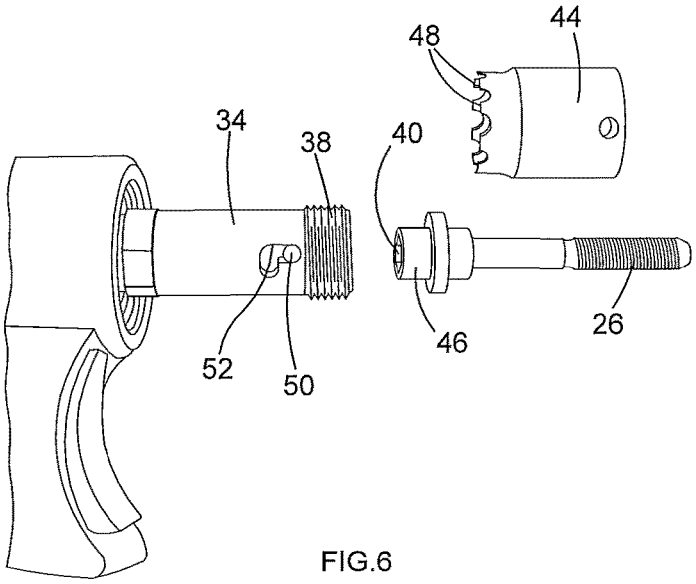
FIG. 6 shows a side view of the power tool rivet gun of FIG. 5 in a disassembled state.

Referring now to FIG. 2 a power tool employing the retention and release mechanism of the present invention is described. The rivet gun is a rivet gun 14 which, in this example, is driven by compressed air which enters the tool 14 via air port 16, in known manner. Although the tool 14 is a hydro-pneumatic one, as has been described above, both the hydraulic oil and the compressed gas operations thereof are powered by this compressed air. The tool 14 is used to insert a threaded insert rivet, or rivet (in this example a so-called "blind" threaded insert) into a pre-formed hole in a workpiece such as a laminate sheet or sheets. The purpose of placing the rivet into the hole in the workpiece is to serve as a permanent threaded fixing piece for subsequent attachments to the workpiece. Examples of such inserts are mounting positions on a metal fence to which rails can be affixed. It can be seen from the figure (and also FIG. 5), that the tool 14 has a protective nose piece 30 engageable with the main body thereof in order to protect the underlying retention and release mechanism form inadvertent damage. The nose piece 30 is omitted from all other drawings for clarity and as it does not, per se, form part of the present invention. The nose piece 30 also serves to carry reaction force due to setting a rivet.

Use of such tools 14 are generally known and so the broad operation of such will not be described herein, as the manner of operation is known to those skilled in the art. The tool 14 may adjust the setting of the rivet by either stroke length or pressure. If the former is desired, then underneath sleeve 22 is an adjustment knob to control the stroke at which the upsetting operation ceases. If the latter is desired, then adjustment knob 18 is set by the operator to control the force of the means for upsetting the rivet when it is set in the workpiece. Actuation of the tool 14 is governed by trigger switch 24.

The operation of the tool 14 is a four-stage process. Stage one is the spin-on process. On the application of axial load upon the drive screw 26 (typically achieved by the operator pushing the rivet onto the drive screw 26), the drive screw 26, under influence of the pneumatic element of the tool 14, rotates in a sense such that the outer thread of the drive screw 26 is caused to insert itself into a corresponding internal thread in a threaded rivet (not shown) which the operator holds. The operator will usually hold the rivet in one hand and present it to the drive screw 26 of the tool 14, which is held in their other hand. The spin-on process is rapid but a low-torque operation (so as not to be a danger to the operator).

For the second stage of the process, a torque detector of any known type senses when the spin-on process is complete, as the drive screw 26 is fully inserted within the rivet. Alternatively sensing of axial end pressure on the drive screw when the rivet contacts drive screw nose tip 28 achieves the same end.

The third stage of the process may commence after the spin-on stops. With the rivet engaged on the drive screw 26 and abutting the nose tip 28, the operator inserts the rivet through the hole in the workpiece and with the operator's finger actuating the trigger switch 24, the hydraulic system of the tool 14 is employed to pull the drive screw 26 axially inward toward to body of the tool 14. In FIG. 2, this means moving the drive screw 26 to the left. As the external thread of the drive screw 26 is still within and engaged with the mating internal thread of the rivet to which it is engaged, this axial movement causes upsetting, or compressive deformation of the rivet. This then sets the upset rivet to lock it permanently in the hole of the workpiece.

The final, fourth stage of the process (which, practically may be indistinguishable to an observer from the third stage) is for the hydraulic system of the tool 14 firstly to operate a return stroke such that the drive screw 26 is moved axially back to its original position and then to cede to the pneumatic system such that axial movement of the drive screw 26 is replaced by the pneumatic system to again rotate the drive screw 26, although at this stage its rotation is in the opposite sense to that of the spin-on such that spin-off occurs. This means that the drive screw 26 unscrews itself from the set rivet. The return stroke and spin-off occur simultaneously. The cycle can then be repeated.

Referring now also to FIGS. 3-10, it can be seen that, in common with the prior art of FIG. 1, a mounting member, in this example a spindle 34, is rotatably coupled (i.e. to provide a torque force thereto) to a drive screw 26 via an intermediate member, in this example drive bit 36. The spindle 34 carries a first external screw thread 38. Drive screw 26 carries a second external screw thread, which is for engaging with a corresponding internal screw thread of a rivet to be set by the tool 14.

The drive screw 26 also carries a second coupling means, in this example a hexagonal recess 40 formed at an end face thereof and which engages with one end of the drive bit 36. The other end of the drive bit 36 engages with the spindle 34 via a first coupling means thereof, in this example, hexagonal recess 42 (see FIG. 10) which is formed in the front end face of the spindle 34.

The bit 36 sits between the hexagonal recess 42 of the spindle 34 and the hexagonal recess 40 of the drive screw 26. In this manner the drive screw 26, via its hexagonal recess 40 may be selectively engaged with the spindle 34 via the drive bit 36. Rotational torque applied by either the spindle 34 or drive screw 26 will, via drive bit 36, be transmitted to the other of the drive screw 26 or spindle 34, therefore.

In order to hold the spindle 34, drive bit 36 and drive screw 26 in place fast against any relative movement therebetween (whether that be axial or rotational relative movement), a releasable locking member, in this example cap 44 is used. Cap 44 has an internal screw thread arranged to selectively couple with the external screw thread 38 of spindle 34. When the cap 44 is threaded onto the spindle 34 (as can be seen most clearly from FIG. 3), it encapsulates the drive bit 36 and also an adaptor sleeve 46, which adaptor sleeve serves the same purpose as the adaptor sleeve referred to in FIG. 1. In this manner, therefore, the spindle 34, drive bit 36, sleeve adaptor 46 and drive screw 26 are held together as a single unit such that any movement imparted to the spindle 34 by the tool 14 is also effected directly upon the drive bit 26, the adaptor sleeve 46 and the drive screw 26. Hence the spindle 34 is drivingly coupled to the drive screw 26 via the drive bit 36. The movement referred to here includes axial as well as rotational movement. Whatever movement the tool 14 imparts to the spindle 34 is transferred to the drive screw 26 by virtue of the cap 44 holding the drive screw 26 to the spindle 34 as a single unit. Those skilled in the art will appreciate that all axial/setting loads are transmitted via drive screw 26, cap 44, adaptor sleeve 46 and spindle 34.

However, as discussed above, there are occasions when the tool 14 operator needs to change any one, or more, of the drive screw 26, the drive bit 36 or the adaptor sleeve 46. This is achieved simply and quickly by a purely manual process according to the present invention.

Figure 7:
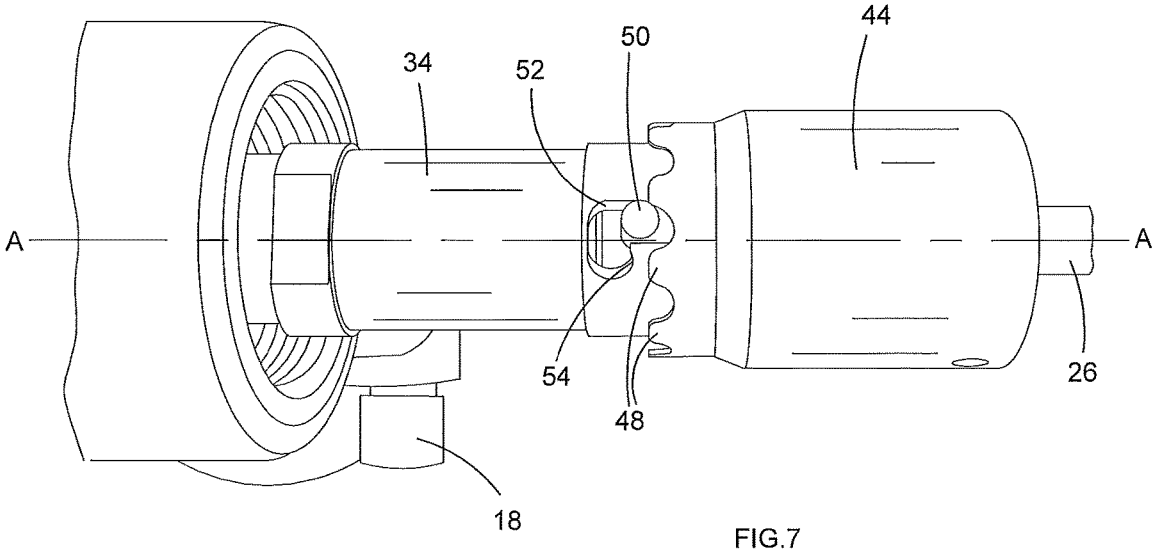
FIG. 7 shows a detailed side view of the power tool rivet gun of FIGS. 5 and 6 with the releasable locking member in situ.
Figure 8:
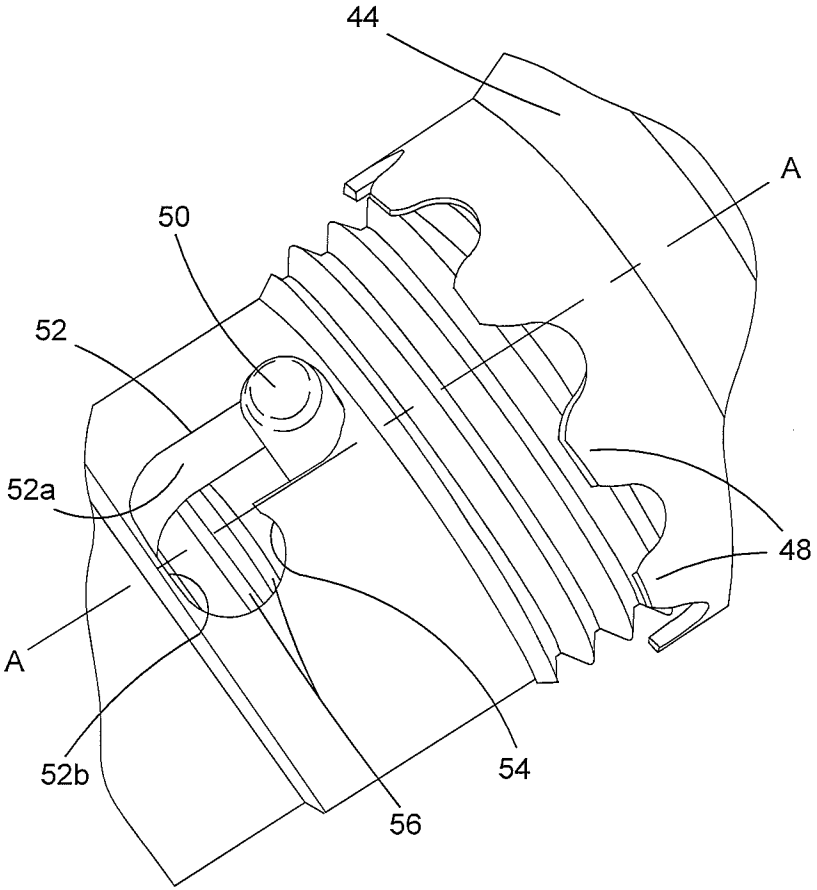
FIG. 8 shows a detailed view of the detent of the present invention.
Figure 9:
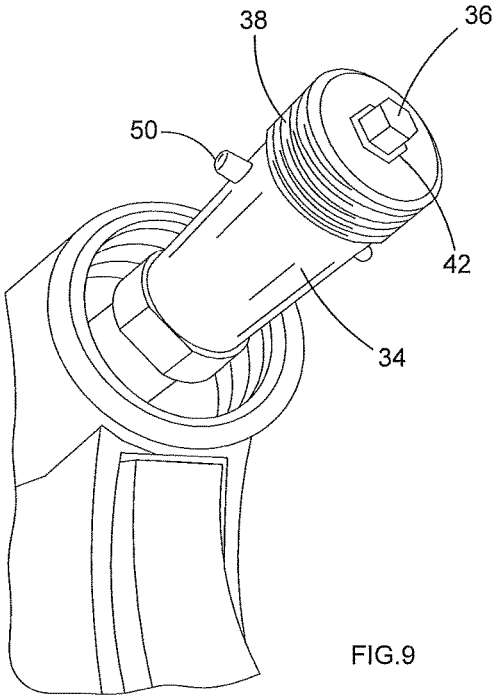
FIG. 9 shows a front perspective view of the tool with the drive bit within the spindle.
Figure 10:
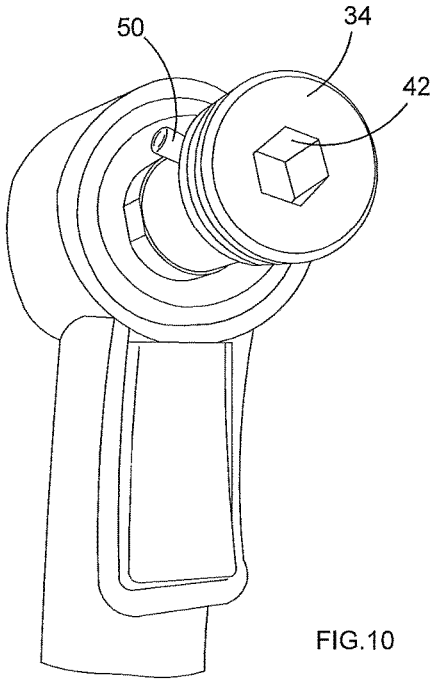
FIG. 10 shows an end view of the tool from the front, with the drive bit removed from the spindle.

Seen most clearly form FIGS. 7 and 8, the proximal end face of the cap 44 is formed in a wave-like manner. In the example shown, the wave is a sine wave-like having a plurality of teeth 48, however, any cyclically-repeating (as viewed travelling around the periphery of the cap 44 wherein the peaks and troughs of the wave extend axially) form may be employed, such as square tooth, saw-tooth, castellations, crenelations, indentations or the like. The only limiting factor is that the wave structure must provide peaks and troughs which can be used as latches, as will be described below.

Cooperating with the teeth 48 of the sine wave is a manually actuable detent, here moveable bar 50. The bar 50 extends diametrically across and within the spindle 34 and beyond its periphery on both sides so that the extreme ends of the bar 50 protrude proud of the outer surface of the spindle. This enables an operator to manually grip and actuate the bar 50, as will be described. The bar 50, which in this example, is formed of metal, is moveable both axially along the spindle axis A-A and rotationally about this axis.

To permit such movement of the bar 50, the spindle 34 is formed with a region exhibiting a generally J-shaped cut-out 52. The cut-out 52 is formed to have a first major leg **52*a* extending axially along A-A to permit movement of the bar 50 axially therealong. The cut-out 52 is also formed with a second, minor leg, 52*b*, which is generally normal to the major leg 52*a* such that the bar 50, when slid to the point of intersection of legs 52*a* and 52*b*** is able to be rotated about the axis A-A.

When the bar 50 is rotated about the axis A-A along the leg **52*b*, it is able to then be held within a slight pocket 54 formed in the cut-out 52 against the force of a compression spring 56 such that the bar 50 is locked in this position until such times as the operator exerts sufficient axial force against the bar to overcome the spring 56 force to reverse this locking process and allow the bar to take up position along the leg 52***a* for return, under the force of spring 56 to its original position as shown in the figures.

It can be seen best from FIG. 8 that the pocket 54 extends axially along A-A to the right of the figure more than is necessary to allow the bar 52 to rotate along the leg 52*b*. This is so that, when the bar is slid axially along the leg 52*a* against the force of the spring 56 and then rotated into the leg 52*b*, on release of the bar 50 by the operator, the force of the spring 56 acts on the bar 50 to push it axially back towards the right of the figure such that the bar 50 is held within the pocket 54 and cannot return accidentally until the operator positively applies sufficient axial force against the spring biasing force to release the bar 50 from the pocket 54, rotate it back into the leg 52*a* and then release it. This provides an over-centre latch mechanism such that the bar 50 has two rest positions. The first position is that shown in the figures (where the bar 50 is to the right along A-A), this being the locked position. The other being when the bar 50 is in the pocket 54, which is the released, or unlocked position.

When the bar 50 is in the unlocked position, the operator is free to screw or unscrew the cap 44, as the bar 50 does not sit within the recesses of any of the teeth 48. When the bar 50 is in the locked position, the operator is unable to screw or unscrew the cap 44, as the bar 50 is captive within two of the teeth 48 (each side of the bar 50 sits within a respective recess of the teeth 48). Thus, when the cap 44 is screwed fully onto the spindle 34 and the bar 50 is in its locked position (which is its normally biased position) it immovably retains the drive screw 26 to the spindle 34 until such times as the operator draws the bar 50 axially against the force of spring 56 to its unlocked position which allows the cap 44 to be unscrewed and the drive screw, or drive bit 36 or adaptor sleeve 46 to be changed.

Those skilled in the art will appreciate that a compression spring 56 is not the only means by which the bar 50 may be biased. Other means for applying a force to the bar may be employed, such as resilient block of material such as rubber, or magnets. All that is required is for a biasing force in one axial direction be permanently applied to the bar 50.

It can be seen from the figures that the spindle 34, cap 44 and drive screw 26 are all axially aligned and co-axial to one another. This arrangement provides a compact mechanism.

The mechanism of the present invention provides a simple and quick means for the operator thereof to be able to release the cap 44 manually and without the need for any tools such as spanners or the like. Once locked, the mechanism retains the cap 44 immovably in place, hence coupling all the component parts of the mechanism together rigidly until such time as the operator manually releases the bar 50 and, hence, cap 44 again.

The invention claimed is:

1. A retention and release mechanism for a power tool comprising:

a mounting member, which mounting member carries a first external screwthread formed thereon and which mounting member includes a first coupling means;

a drive screw, which drive screw carries a second external screwthread formed thereon and which drive screw includes a second coupling means, the second coupling means arranged for selective engagement with the first coupling means of the mounting member;

a releasable locking member arranged to be selectively coupled to both the mounting member and the drive screw for immovable retention of the drive screw to the mounting member, and;

a manually-actuable detent having a locked position and a released position wherein, in the locked position, the detent restrains the releasable locking member against rotation to prevent uncoupling of the mounting member from the drive screw and in the released position, the detent allows uncoupling of the mounting member from the drive screw;

wherein the releasable locking member has a portion thereof formed with a wave structure, which cooperates with the detent to prevent relative movement between the releasable locking member and the detent when the detent is in the locked position.

2. The retention and release mechanism of claim 1, wherein the detent is biased towards the locked position.

3. The retention and release mechanism of claim 2, wherein the detent is biased via a compression spring.

4. The retention and release mechanism of claim 1, wherein the releasable locking member carries a third internal screwthread to mate with the first external screwthread of the mounting means.

5. The retention and release mechanism of claim 1, wherein the mounting member, the drive screw and the releasable locking member are all arranged co-axially and concentrically about a drive axis (A-A).

6. The retention and release mechanism of claim 5, wherein the detent is moved axially between the locked and released position.

7. The retention and release mechanism of claim 5, wherein the detent is also rotated about the drive axis in order to move from its locked position towards its released position, or vice versa.

8. The retention and release mechanism of claim 1, wherein the first coupling means of the mounting member selectively engages with the second coupling means of the drive screw via an intermediate member.

9. The retention and release mechanism of claim 8, wherein the intermediate member is arranged to transmit torque between the mounting member and the drive screw.

10. The retention and release mechanism of claim 9, wherein the intermediate member is a drive bit.

11. A power tool including the retention and release mechanism of claim 1.

* * * * *